US008737904B2

(12) United States Patent
Liu et al.

(10) Patent No.: US 8,737,904 B2
(45) Date of Patent: May 27, 2014

(54) DELIVERY APPARATUS

(75) Inventors: Yu Liu, Mississauga (CA); Sarah J. Vella, Milton (CA); Richard A. Klenkler, Oakville (CA); Gregory M. McGuire, Oakville (CA); Nan-Xing Hu, Oakville (CA); Vladislav Skorokhod, Concord (CA); Paul J. Gerroir, Oakville (CA)

(73) Assignee: Xerox Corporation, Norwalk, CT (US)

( * ) Notice: Subject to any disclaimer, the term of this patent is extended or adjusted under 35 U.S.C. 154(b) by 60 days.

(21) Appl. No.: 13/354,022

(22) Filed: Jan. 19, 2012

(65) Prior Publication Data

US 2013/0189013 A1 Jul. 25, 2013

(51) Int. Cl.
*G03G 15/00* (2006.01)

(52) U.S. Cl.
USPC ..... 399/397; 399/313

(58) Field of Classification Search
USPC ..... 399/100, 397
See application file for complete search history.

(56) References Cited

U.S. PATENT DOCUMENTS

| | | | | |
|---|---|---|---|---|
| 3,121,006 | A | 2/1964 | Middleton et al. | |
| 4,387,980 | A | 6/1983 | Ueno et al. | |
| 4,435,074 | A | 3/1984 | Midorikawa et al. | |
| 4,464,450 | A | 8/1984 | Teuscher | |
| 4,587,189 | A | 5/1986 | Hor et al. | |
| 4,664,995 | A | 5/1987 | Horgan et al. | |
| 4,921,773 | A | 5/1990 | Melnyk et al. | |
| 5,069,993 | A | 12/1991 | Robinette et al. | |
| 5,384,929 | A * | 1/1995 | Smith | 15/104.061 |
| 5,499,089 | A * | 3/1996 | Tsukamoto et al. | 399/328 |
| 5,646,718 | A | 7/1997 | Suwa et al. | |
| 5,756,245 | A | 5/1998 | Esteghamatian et al. | |
| 6,434,357 | B1 | 8/2002 | Maul et al. | |
| 6,582,222 | B1 | 6/2003 | Chen et al. | |
| 6,869,918 | B2 | 3/2005 | Cornelius | |
| 7,428,402 | B2 | 9/2008 | Hays et al. | |
| 7,526,243 | B2 | 4/2009 | Zaman et al. | |
| 7,580,655 | B2 | 8/2009 | Nukada et al. | |
| 7,725,069 | B2 | 5/2010 | Kawahara et al. | |
| 7,734,242 | B2 | 6/2010 | Hatakeyama et al. | |
| 7,877,054 | B1 | 1/2011 | Thayer et al. | |
| 7,881,651 | B2 | 2/2011 | Watanabe | |
| 7,960,082 | B2 | 6/2011 | Aziz et al. | |
| 8,600,281 | B2 | 12/2013 | Hu et al. | |
| 2003/0049555 | A1 | 3/2003 | Sakon et al. | |
| 2003/0118372 | A1 * | 6/2003 | Kitano et al. | 399/176 |

(Continued)

FOREIGN PATENT DOCUMENTS

JP 2002357983 A 12/2002

OTHER PUBLICATIONS

U.S. Appl. No. 13/192, 252, filed Jul. 27, 2011.
U.S. Appl. No. 13/192,215, filed Jul. 27, 2011.

(Continued)

*Primary Examiner* — Clayton E Laballe
*Assistant Examiner* — Jas Sanghera
(74) *Attorney, Agent, or Firm* — Hoffman Warnick LLC

(57) ABSTRACT

There is described a delivery member for use in an image forming apparatus. The delivery member includes a cylindrical support member and an outer layer. The outer layer comprises an outer surface. The outer surface comprises a first surface section and a second surface section. The first surface section comprises an elastomeric matrix having a functional material dispersed therein and the second surface section comprises a cleaning material.

18 Claims, 5 Drawing Sheets

(56) References Cited

U.S. PATENT DOCUMENTS

| | | | | |
|---|---|---|---|---|
| 2005/0163527 | A1* | 7/2005 | Tombs | 399/98 |
| 2009/0087213 | A1* | 4/2009 | Takaya et al. | 399/100 |
| 2009/0162092 | A1* | 6/2009 | Hoshio | 399/100 |
| 2009/0185821 | A1 | 7/2009 | Iwamoto et al. | |
| 2009/0220876 | A1 | 9/2009 | De Jong et al. | |
| 2010/0189461 | A1 | 7/2010 | Shintani et al. | |
| 2011/0033798 | A1 | 2/2011 | Kim et al. | |
| 2011/0206430 | A1 | 8/2011 | Arai et al. | |

OTHER PUBLICATIONS

U.S. Appl. No. 13/020,738, filed Feb. 3, 2011.
U.S. Appl. No. 12/845,662, filed Jul. 28, 2010.
U.S. Appl. No. 13/286,905, filed Nov. 1, 2011.
Walsh, U.S. Appl. No. 13/279,981, Office Action dated Nov. 6, 2013, 20 pages.
U.S. Appl. No. 13/533,475, Notice of Allowance and Fees Due, Dec. 9, 2013, 20 pages.
U.S. Appl. No. 13/437,472, Office Action, Dec. 20, 2013, 18 pages.
U.S. Appl. No. 13/426,836, Ex Parte Quayle Action dated Mar. 20, 2014, XRX-0078, 18 pages.
U.S. Appl. No. 13/437,472, Notice of Allowance & Fees Due, Mar. 31, 2014, 7 pages.
U.S. Appl. No. 13/326,414, Office Action, Mar. 28, 2014, 19 pages.

* cited by examiner

DELIVERY APPARATUS

BACKGROUND

1. Field of Use

This disclosure is generally directed to the delivery of a functional material or lubricant to the surface of imaging members, photoreceptors, photoconductors, and the like. The disclosure is also directed to the cleaning of the surface of charging members.

2. Background

In electrophotography or electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images.

To charge the surface of a photoreceptor, a contact type charging device has been used, such as disclosed in U.S. Pat. No. 4,387,980 and U.S. Pat. No. 7,580,655, which are incorporated herein by reference in their entirety. The contact type charging device, also termed "bias charge roll" (BCR) includes a conductive member which is supplied a voltage from a power source with a D.C. voltage superimposed with an A.C. voltage of no less than twice the level of the D.C. voltage. The charging device contacts the image bearing member (photoreceptor) surface, which is a member to be charged. The contact type charging device charges the image bearing member to a predetermined potential.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

In recent years, organic photoreceptor has been widely used for electrographic purposes. This is because organic photoreceptors are easy to prepare at low cost and have the advantages of mechanical flexibility, easy disposability and environmental sustainability. However, the microcorona generated during repetitive charging, damages the organic photoconductor, resulting in a rapid wear of the imaging surface.

To further increase the service life of the photoreceptor, use of overcoat layers has also been implemented to protect photoreceptors and improve performance, such as wear resistance. However, these low wear overcoats are associated with poor image quality due to A-zone deletion in a humid environment as the wear rates decrease to a certain level. In addition, high torque associated with low wear overcoats in A-zone also causes severe issues with BCR charging systems, such as motor failure, blade damage and contamination on the BCR and the photoreceptor. As a result, use of a low wear overcoat with BCR charging systems is still a challenge, and there is a need to find ways to increase the life of the photoreceptor.

SUMMARY

Disclosed herein is a delivery member for use in an image forming apparatus. The delivery member comprises a cylindrical support member and an outer layer. The outer layer comprises an outer surface. The outer surface comprises a first surface section and a second surface section. The first surface section comprises an elastomeric matrix having a functional material dispersed therein and the second surface section comprises a cleaning material.

Disclosed herein is an image forming apparatus comprising an imaging member having a charge retentive-surface for developing an electrostatic latent image thereon. The imaging member comprises a substrate and a photoconductive member disposed on the substrate. The imaging apparatus includes a charging unit for applying an electrostatic charge on the imaging member to a predetermined electric potential. The imaging apparatus includes a delivery member in contact with a surface of the charging unit. The delivery member comprises a cylindrical support member and an outer layer disposed on the support member. The outer layer comprises an outer surface that includes a first surface section and a second surface section. The first surface section comprises an elastomeric matrix having a functional material dispersed therein and the second surface section comprises a cleaning material.

Disclosed herein is a delivery apparatus use in an image forming apparatus. The delivery apparatus includes a cylindrical support member and an inner layer disposed on the support member comprising an elastomeric matrix impregnated with a functional material. An outer layer is disposed on the inner layer, the outer layer comprising an outer surface that includes a first surface section and a second surface section. The first surface section comprises an elastomeric matrix having a functional material dispersed therein. The second surface section comprises a cleaning material.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
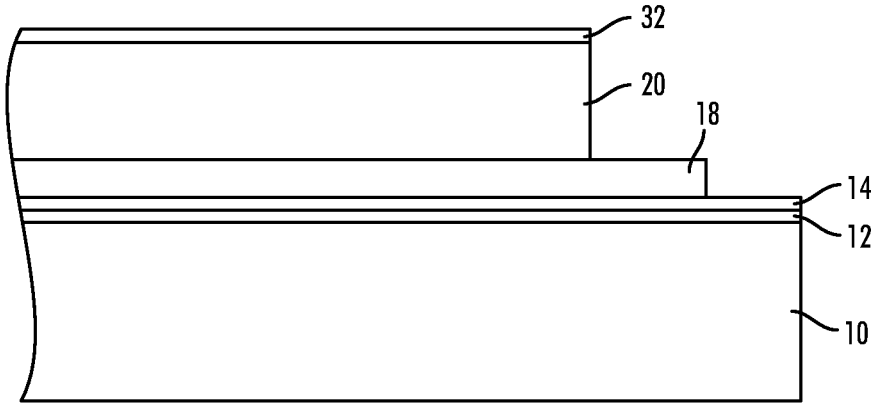
FIG. 1 is a cross-sectional view of an imaging member in a drum configuration according to the present embodiments.

FIG. 1 is an exemplary embodiment of a multilayered electrophotographic imaging member or photoreceptor having a drum configuration. The imaging member may further be in a cylinder configuration. As can be seen, the exemplary imaging member includes a rigid support substrate 10, an electrically conductive ground plane 12, an undercoat layer 14, a charge generation layer 18 and a charge transport layer 20. An optional overcoat layer 32 disposed on the charge transport layer 20 may also be included. The substrate 10 may be a material selected from the group consisting of a metal, metal alloy, aluminum, zirconium, niobium, tantalum, vanadium, hafnium, titanium, nickel, stainless steel, chromium, tungsten, molybdenum, and mixtures thereof. The substrate 10 may also comprise a material selected from the group consisting of a metal, a polymer, a glass, a ceramic, and wood.

The charge generation layer 18 and the charge transport layer 20 form an imaging layer described here as two separate layers. In an alternative to what is shown in the figure, the charge generation layer 18 may also be disposed on top of the charge transport layer 20. It will be appreciated that the functional components of these layers may alternatively be combined into a single layer.

Figure 2:
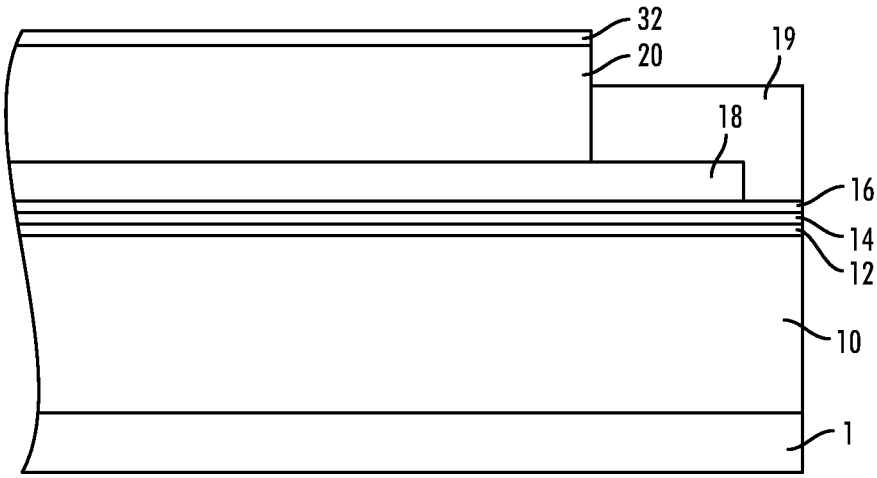
FIG. 2 is a cross-sectional view of an imaging member in a belt configuration according to the present embodiments.

FIG. 2 shows an imaging member or photoreceptor having a belt configuration according to embodiments. As shown, the belt configuration is provided with an anti-curl back coating 1, a support substrate 10, an electrically conductive ground plane 12, an undercoat layer 14, an adhesive layer 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference in its entirety.

As discussed above, an electrophotographic imaging member generally comprises at least a substrate layer, an imaging layer disposed on the substrate and an optional overcoat layer disposed on the imaging layer. In further embodiments, the imaging layer comprises a charge generation layer disposed on the substrate and the charge transport layer disposed on the charge generation layer. In other embodiments, an undercoat layer may be included and is generally located between the substrate and the imaging layer, although additional layers may be present and located between these layers. The imaging member may also include an anti-curl back coating layer in certain embodiments. The imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing charged particles of same or opposite polarity on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Common print quality issues are strongly dependent on the quality and interaction of these photoreceptor layers. For example, when a photoreceptor is used in combination with a contact charger and a toner obtained by chemical polymerization (polymerization toner), image quality may deteriorate due to a surface of the photoreceptor being stained with a discharge product produced in contact charging or the polymerization toner remaining after a cleaning step. Still further, repetitive cycling causes the outermost layer of the photoreceptor to experience a high degree of frictional contact with other machine subsystem components used to clean and/or prepare the photoreceptor for imaging during each cycle. When repeatedly subjected to cyclic mechanical interactions against the machine subsystem components, a photoreceptor can experience severe frictional wear at the outermost organic photoreceptor layer surface that can greatly reduce the useful life of the photoreceptor. Ultimately, the resulting wear impairs photoreceptor performance and thus image quality. Another type of common image defect is thought to result from the accumulation of charge somewhere in the photoreceptor. Consequently, when a sequential image is printed, the accumulated charge results in image density changes in the current printed image that reveals the previously printed image. In the xerographic process spatially varying amounts of positive charges from the transfer station find themselves on the photoreceptor surface. If this variation is large enough it will manifest itself as a variation in the image potential in the following xerographic cycle and print out as a defect.

A conventional approach to photoreceptor life extension is to apply an overcoat layer with wear resistance. For bias charge roller (BCR) charging systems, overcoat layers are associated with a trade-off between A-zone deletion (i.e. an image defect occurring in A-zone: 28° C., 85% RH) and photoreceptor wear rate. For example, most organic photoconductor (OPC) materials sets require a certain level of wear rate in order to suppress A-zone deletion, thus limiting the life of a photoreceptor. The present embodiments, however, have demonstrated a decrease in wear rate of a photoreceptor while maintaining the image quality of the photoreceptor, such as decreased image deletions. The present embodiments provide photoreceptor technology for BCR charging systems with a significantly expanded life.

The disclosed embodiments are directed generally to a delivery apparatus. The delivery roller includes an outer layer having an outer surface that has two surface sections. The first surface section for delivering a functional material to the surface of the BCR and the second surface section comprising a cleaning material that cleans the surface of the BCR. Intermittent contact of the first surface section with the BCR solves high torque and A-zone deletion problems and intermittent contact of the second surface section with the BCR enhances the capability of the delivery roll to suppress BCR contamination, especially the cleaning of nano-size additive particles. In embodiments, the first section comprises from about 10 percent to about 90 percent of the outer surface, or from 30 percent to about 80 percent of the outer surface, or from 40 percent to about 75 percent of the outer surface.

The present embodiments employ a delivery apparatus and system to deliver a layer of functional materials onto the photoreceptor surface either directly or through a charging roller. The functional material is applied to the photoreceptor surface and acts as a lubricant and or a barrier against moisture and surface contaminants and improves xerographic performance in high humidity conditions, such as, for example, A-zone environment. The ultra-thin layer may be provided on a nano-scale or molecular level.

Figure 3:
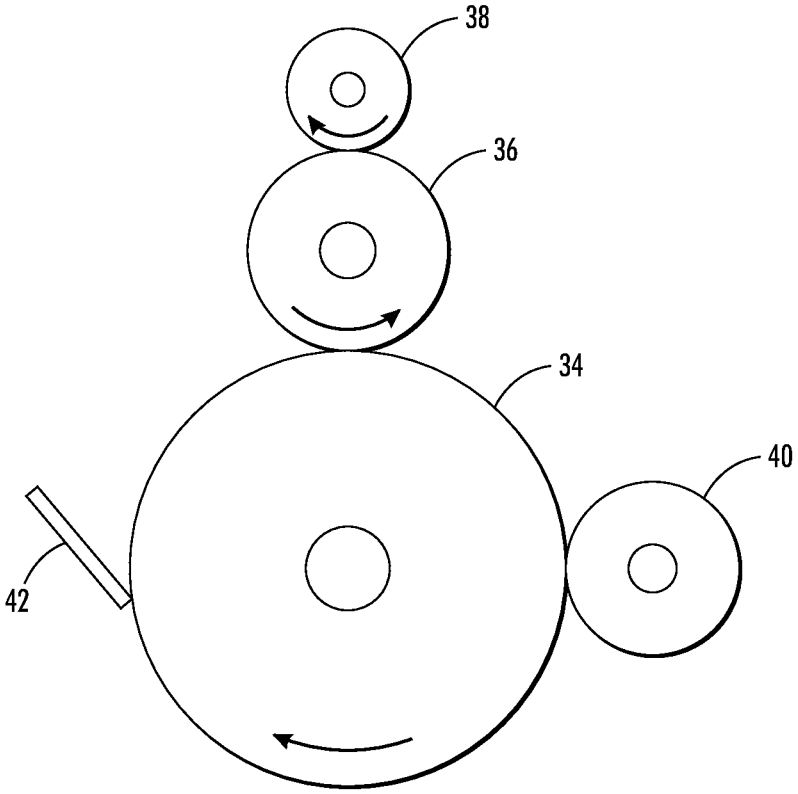
FIG. 3 is a cross-sectional view of a system implementing a delivery member according to the present embodiments.
Figure 4:
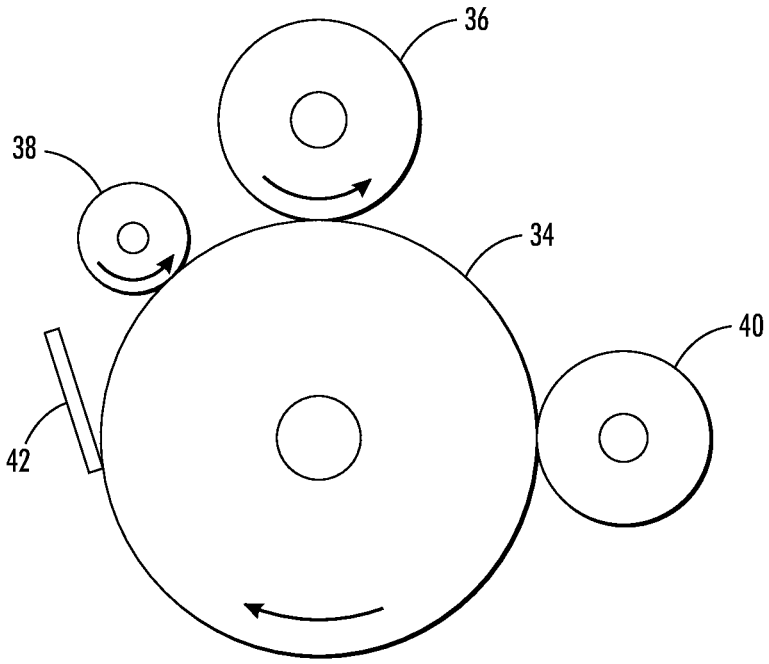
FIG. 4 is an alternative cross-sectional view of a system implementing a delivery member according to the present embodiments.

FIGS. 3-7 illustrate delivery members according to the present embodiments. In FIG. 3, there is illustrated an image-forming apparatus in a BCR charging system. As shown, a delivery member 38 contacts a BCR 36 to deliver an ultra-thin layer of the functional material onto the surface of the BCR 36. The BCR 36, in turn, transfers the functional material onto the surface of a photoreceptor 34. The delivery member 38 may be integrated into a xerographic printing system in various configurations and positions. As can be seen, as the overcoated photoreceptor drum 34 rotates, the delivery member 38 impregnated with the functional material delivers said material to the surface of the BCR 36 which then transfers the functional material to the surface of the photoreceptor 34. In addition, the delivery member 38 continuously cleans the surface of the BCR 36. Alternatively, the delivery member 38 can be in direct contact with the photoreceptor 34 to deliver the functional material directly (FIG. 4). The photoreceptor 34 is substantially uniformly charged by the BCR 36 to initiate the electrophotographic reproduction process. The charged photoreceptor 34 is then exposed to a light image to create an electrostatic latent image on the photoreceptive member (not shown). This latent image is subsequently developed into a visible image by a toner developer 40. Thereafter, the developed toner image is transferred from the photoreceptor member through a record medium to a copy sheet or some other image support substrate to which the image may be permanently affixed for producing a reproduction of the original document (not shown). The photoreceptor surface is generally then cleaned with a cleaner 42 to remove any residual developing material therefrom, in preparation for successive imaging cycles.

Figure 5:
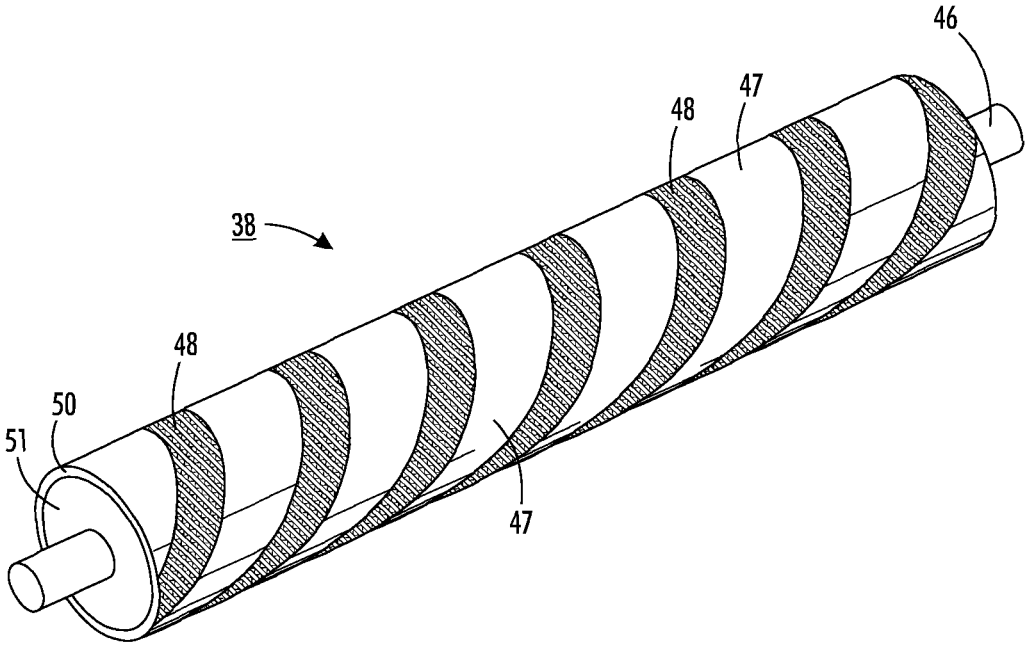
FIG. 5 is a side view of a delivery member according to the present embodiments.

In addition to delivering a functional material to the surface to the BCR 36, the delivery member 38 cleans the surface of the BCR 36. The delivery member 38 is described in more detail below FIG. 5 illustrates the delivery member 38 according to the present embodiments. The delivery member 38 comprises an outer layer 50 containing two surface sections 47 and 48. Surface section 47 comprises an elastomeric matrix impregnated with a functional material. Surface section 48 comprises a cleaning material. Shown in FIG. 5 is an optional inner layer 51 which supports outer layer 50. Support member 46 supports the inner layer 51. Without an inner layer 51, outer layer 50 is supported by support member 46. In the embodiment shown in FIG. 5, surface section 48 is helically wrapped around the delivery member 38. The helical wrap is affixed or embedded in surface section 47.

The manner in which surface section 48 is wrapped along the elastomeric layer can affect the contact between the cleaning surface section 47 and the BCR. For an embedded design, there are no contact issues.

Figure 6:
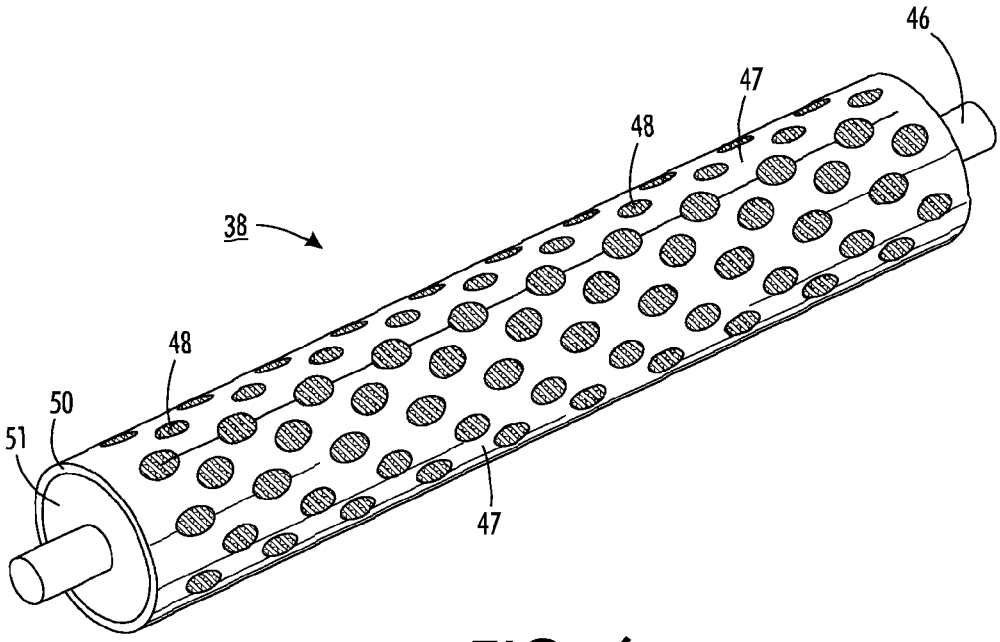
FIG. 6 is a side view of a delivery member according to the present embodiments.

FIG. 6 illustrates another embodiment of the delivery member 38 according to the present embodiments. The delivery member 38 comprises an outer surface containing two surface sections 47 and 48. Surface section 47 comprises an elastomeric matrix impregnated with a functional material. Surface section 48 comprises a cleaning material and is positioned as discrete patches on the outer surface. Shown in FIG. 6 is an optional inner layer 51 which supports outer layer 50. Support member 46 supports the inner layer 51. Without an inner layer 51, outer layer 50 is supported by support member 46. In the embodiment shown in FIG. 6, surface section 48 is embedded or affixed to surface section 47. The discrete patches of surface section 48 can be any shape. Shapes such as circles, rods, ovals, squares, triangles, polygons, and mixtures thereof are included in the embodiments. The patches are positioned longitudinally along the outer surface so that when the delivery member 38 is rotated the outer surface of the BCR will contact at least one patch.

Figure 7:
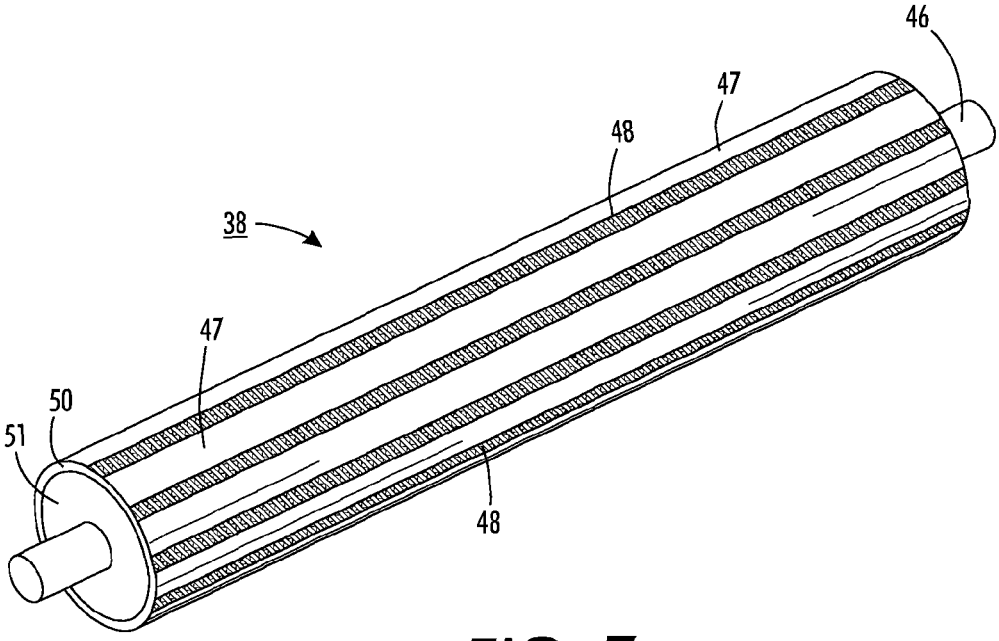
FIG. 7 is a side view of a delivery member according to the present embodiments.

FIG. 7 illustrates an alternate embodiment of delivery member 38 according to the present embodiments. The delivery member 38 comprises an outer surface containing two surface sections 47 and 48. Surface section 47 comprises an elastomeric matrix impregnated with a functional material. Surface section 48 comprises a cleaning material, and is affixed or embedded in surface section 47 as at least one longitudinal strip. Shown in FIG. 7 is an optional inner layer 51 which supports outer layer 50. Support member 46 supports the inner layer 51. Without an inner layer 51, outer layer 50 is supported by support member 46.

In embodiments, the support member 46 is a stainless steel rod. The support member 46 can further comprise a material selected from the group consisting of metal, metal alloy, plastic, ceramic, and glass, and mixtures thereof.

The diameter of the support member 46 and the thickness of the inner layer 51 may be varied depending on the application needs. In specific embodiments, the support member has a diameter of from about 3 mm to about 10 mm.

In the present embodiments, the functional material contained in section 47 is delivered to the surface of the outer surface layer. The functional material is transferred to the surface of the imaging member indirectly through transfer to the BCR surface (FIG. 3). Delivery members fabricated according to the present embodiments have shown to contain sufficient quantities of the functional material to continuously supply an ultra-thin layer of the functional material to the surface of the photoreceptor.

A long life photoreceptor (P/R) enables significant cost reduction. Generally P/R life extension is achieved with a wear-resistant overcoat. However, wear resistant overcoats are associated with an increase in A-zone deletion (a printing defect that occurs at high humidity). Most organic photoreceptor materials require a minimal wear rate of 2 nm/Kcycle (Scorotron charging system) or from about 5 nm/Kcycle to about 10 nm/Kcycle (BCR charging system) in order to suppress A-zone deletion. In addition, wear-resistant overcoats cause a higher torque that results in issues with BCR (bias charging roller) charging systems, such as motor failure and blade damage (which results in streaking of toner in prints). The surface section 47 is composed of an elastomeric material having pores to deliver the functional material to the surface of the delivery member 38 (less than about 1 μm, or less than about 500 nm or less than about 300 nm). The delivery members 38 shown in FIG. 4-6 can be constructed with an inner layer 51 of elastomeric material to support the outer surface. In such an embodiment the pores of the inner layer 51 are from about 0.01 microns to about 50 microns, or the pores are from about 8 microns to about 20 microns, or the pores are from about 10 microns to about 17 microns. The pores of the inner layer 51 are filled with functional material. The smaller pores of the outer layer of surface section 47 control the diffusion of the functional material from the inner layer to the outer surface. The double layer roller applies an ultra-thin film of functional material to the surface of the BCR while also cleaning the BCR surface.

In embodiments, the functional material can be an organic or inorganic compound, oligomer or polymer, or a mixture thereof. The functional materials may be in the form of liquid, wax, or gel, and a mixture thereof. The functional material may also be selected from the group consisting of a lubricant material, a hydrophobic material, an oleophobic material, an amphiphilic material, and mixtures thereof. Illustrative examples of functional materials may include, for example, a liquid material selected from the group consisting of hydrocarbons, fluorocarbons, mineral oil, synthetic oil, natural oil, and mixtures thereof. The functional materials may further contain a functional group that facilitates adsorption of the functional materials on the photoreceptor surface, and optionally a reactive group that can chemically modify the photoreceptor surface. For example, the functional materials may comprise paraffinic compound, alkanes, fluoroalkanes, alkyl silanes, fluoroalkyl silanes alkoxy-silanes, siloxanes, glycols or polyglycols, mineral oil, synthetic oil, natural oil or mixture thereof.

In embodiments, the inner layer may be comprised of a polymer selected from the group consisting of polysiloxanes, polyurethanes, polyesters, fluoro-silicones, polyolefin, fluoroelastomers, synthetic rubber, natural rubber, and mixtures thereof.

In embodiments, the surface section 47 is a polymer selected from the group consisting of polysiloxane, silicones, polyurethane, polyester, fluoro-silicone, polyolefin, fluoroelastomer, synthetic rubber, natural rubber and mixtures thereof.

In embodiments, the surface section 48 may be a foamed material. The material is selected from the group consisting of polyurethane polyamide, melamine resin, polyester, polysiloxanes, polyethylene, polyacrylates, natural rubber, or synthetic rubber. In addition, the surface section 48 may be in the form of a brush.

In a specific embodiment, the surface section 47 is a paraffin-impregnated silicone cast around the support member 46. The surface section 47 of paraffin-impregnated silicone can be prepared by mixing paraffin into a cross-linkable polydimethylsiloxane (PDMS) and then casting the mixture onto the support member 46 by use of a mold. Thereafter, the PDMS is cured. Surface section 48 is wrapped or affixed to surface section 47.

The thickness of the surface layer may be varied. For example, the surface layer can have a thickness from about 0.1 μm to about 50 mm, or from about or from about 100 μm to about 20 mm or from about 1 mm to about 5 mm.

In embodiments, the amount of functional material delivered onto the photoreceptor surface should be sufficient to retain the photoreceptor performance properties. The functional material can be delivered to the BCR surface and then to the photoreceptor surface at various amounts, for example, at a molecular level, or amount of from about 0.1 ng/cm$^2$ to about 1 μg/cm$^2$, or from about 0.5 ng/cm$^2$ to about 0.1 μg/cm$^2$, or from about 1 ng/cm$^2$ to about 50 ng/cm$^2$ when the photoreceptor surface is a drum. The present embodiments provide a system (OCL P/R with a delivery roll) that exhibits both reduced photoreceptor wear rate, as well as reduced streaking and A-zone deletion in images as compared to a system without a delivery roll.

The description below describes embodiments of photoconductors

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 15 micrometers or from about 1 micrometer to about 10 micrometers, or in a specific embodiment, about 3 micrometers to about 10 micrometers. These overcoating layers typically comprise a charge transport component and an optional organic polymer or inorganic polymer. These overcoating layers may include thermoplastic organic polymers or cross-linked polymers such as thermosetting resins, UV or e-beam cured resins, and the likes. The overcoat layers may further include a particulate additive such as metal oxides including aluminum oxide and silica, or low surface energy polytetrafluoroethylene (PTFE), and combinations thereof.

Any known or new overcoat materials may be included for the present embodiments. In embodiments, the overcoat layer may include a charge transport component or a cross-linked charge transport component. In particular embodiments, for example, the overcoat layer comprises a charge transport component comprised of a tertiary arylamine containing a substituent capable of self cross-linking or reacting with the polymer resin to form a cured composition. Specific examples of charge transport components suitable for overcoat layer comprise the tertiary arylamine with a general formula of

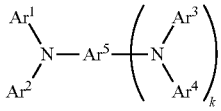

wherein $Ar^1$, $Ar^2$, $Ar^3$, and $Ar^4$ each independently represents an aryl group having about 6 to about 30 carbon atoms, $Ar^5$ represents aromatic hydrocarbon group having about 6 to about 30 carbon atoms, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 to about 10 carbons), a hydroxylalkyl having 1 to about 10 carbons, and mixtures thereof. In other embodiments, $Ar^1$, $Ar^2$, $Ar^3$, and $Ar^4$ each independently represent a phenyl or a substituted phenyl group, and $Ar^5$ represents a biphenyl or a terphenyl group.

Additional examples of charge transport components which comprise a tertiary arylamine include the following:

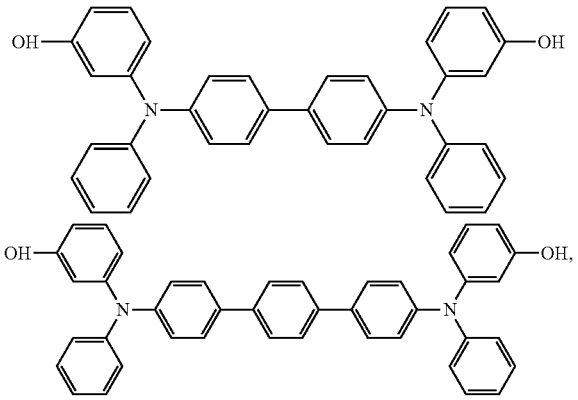

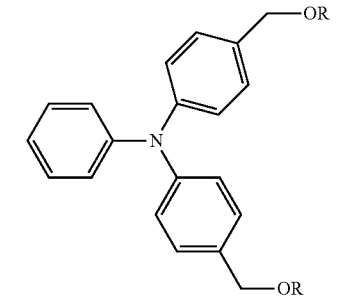

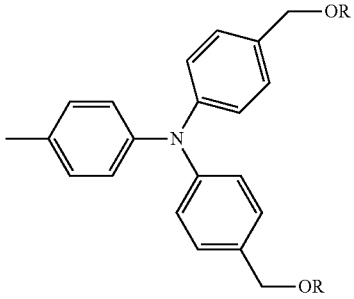

-continued

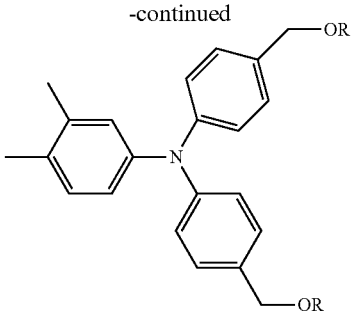

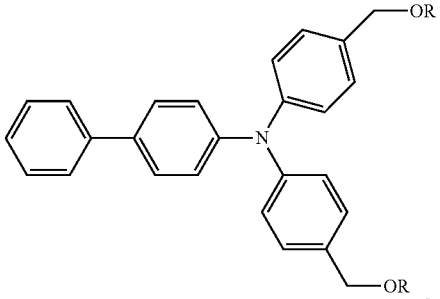

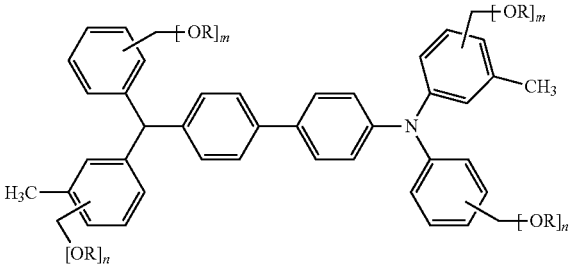

and the like, wherein R is a substituent selected from the group consisting of a hydrogen atom, and an alkyl having from 1 to about 6 carbons, and m and n each independently represents 0 or 1, wherein m+n>1. In specific embodiments, the overcoat layer may include an additional curing agent to form a cured, crosslinked overcoat composition. Illustrative examples of the curing agent may be selected from the group consisting of a melamine-formaldehyde resin, a phenol resin, an isocyalate or a masking isocyalate compound, an acrylate resin, a polyol resin, or mixtures thereof. In embodiments, the crosslinked overcoat composition has an average modulus ranging from about 3 GPa to about 5 GPa, as measured by nano-indentation method using, for example, nanomechanical test instruments manufactured by Hysitron Inc. (Minneapolis, Minn.).

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate be a single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a conductive ground plane 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3\ Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The hole blocking layers that contain metal oxides such as zinc oxide, titanium oxide, or tin oxide, may be thicker, for example, having a thickness up to about 25 micrometers. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of between about 0.05:100 to about 0.5:100 for the hole blocking layer material and solvent is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 nm and about 900 nm during the imagewise radiation exposure step in an electrophotographic imaging process to form an electrostatic latent image. For example, hydroxygallium phthalocyanine absorbs light of a wavelength of from about 370 nm to about 950 nm, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments of the charge generation layer 18 may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The charge transport layer 20 is normally transparent in a wavelength region in which the electrophotographic imaging member is to be used when exposure is affected there to ensure that most of the incident radiation is utilized by the underlying charge generation layer 18. The charge transport layer 20 should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erasure may be accomplished through the substrate 10 with all light passing through the back side of the substrate 10. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 micrometers to about 75 micrometers, and more specifically, of a thickness of from about 15 micrometers to about 40 micrometers. Examples of charge transport components are aryl amines of the following formulas/structures:

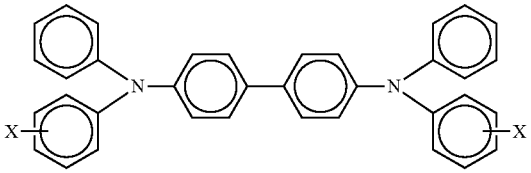

and

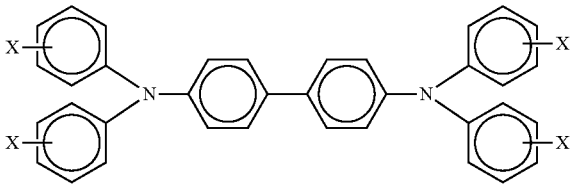

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

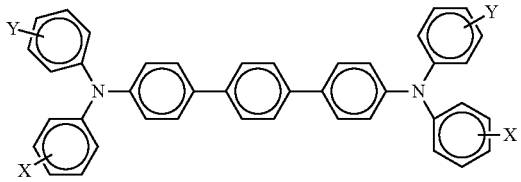

and

-continued

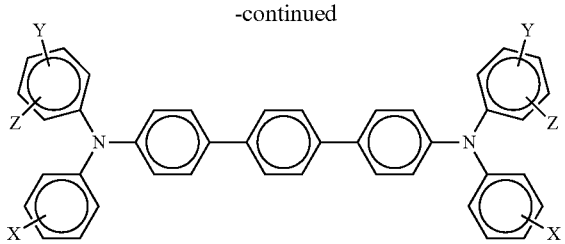

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference in their entirety.

Examples of the binder materials selected for the charge transport layers include components, such as those described in U.S. Pat. No. 3,121,006, the disclosure of which is totally incorporated herein by reference in its entirety. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Layer

An optional separate adhesive interface layer may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Anti-Curl Back Coating Layer

The anti-curl back coating 1 may comprise organic polymers or inorganic polymers that are electrically insulating or slightly semi-conductive. The anti-curl back coating provides flatness and/or abrasion resistance.

Anti-curl back coating 1 may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

Various exemplary embodiments encompassed herein include a method of imaging which includes generating an electrostatic latent image on an imaging member, developing a latent image, and transferring the developed electrostatic image to a suitable substrate.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

Prints were obtained using a low-wear overcoated P/R in a test machine (Xerox WorkCentre 7345) without a delivery roll. The images obtained showed severe A-zone deletion and streaking caused by blade chatter, high torque, and BCR contamination after only a few hundreds of cycles. There was severe contamination on the BCR. The cleaning systems of the commercial machines are not effective at eliminating contamination when overcoated P/Rs are used.

An embodiment of the design described in FIG. 5 was manufactured and tested. A polydimethyksiloxane (PDMS) delivery roll having been impregnated with paraffin was wrapped in a helical manner with an open cell foam material of polyurethane. A test device in which half the length was delivery roll as described above and half the length was a delivery roll of paraffin impregnated PDMS was prepared and used for testing in the same machine.

The delivery roll as shown in FIG. 5 effectively prevented contamination on the BCR for more than 15,000 cycles. In addition, the delivery roll was effective in minimizing deletion and high-torque in A-zone. In comparison, a delivery roll of just PDMS and paraffin oil was not as effective for cleaning the BCR. A BCR cleaning foam was also ineffective at cleaning the BCR, such as after 3000 cycles when the low-wear P/R was used. The portion of the print resulting from contact with delivery roll/cleaning foam design had good image quality and the BCR was not contaminated after 15,000 cycles. In contrast, the portion of the print that had no delivery or cleaning system resulted in poor image quality (streaking and deletion).

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. A delivery apparatus for use in an image forming apparatus comprising:

a cylindrical support member, and an outer layer disposed on the support member comprising an outer surface, the outer surface comprising a first surface section and a second surface section, the first surface section comprising an elastomeric matrix having a functional material dispersed therein and the second surface section comprising a cleaning material, wherein the functional material comprises paraffin oil.

2. The delivery apparatus of claim 1 wherein the first surface section comprises from about 10 percent to about 90 percent of the outer surface.

3. The delivery apparatus of claim 1 wherein the second surface section comprises discrete patches comprising shapes selected from a group consisting of a circles, rods, ovals, squares, triangles, polygons, and mixtures thereof.

4. The delivery apparatus of claim 1 wherein the second surface section comprises a helical strip around the outer surface.

5. The delivery apparatus of claim 1 wherein the second surface section comprises at least one longitudinal strip.

6. The delivery apparatus of claim 1 wherein the second surface section is embedded in the first surface section.

7. The delivery apparatus of claim 1 wherein the second surface section is affixed around the first surface section.

8. The delivery apparatus of claim 1, wherein the elastomeric matrix comprises a material selected from the group consisting of polysiloxane, polyurethane, polyester, polyfluorosilioxanes, polyolefin, fluoroelastomer, synthetic rubber, natural rubber, and mixtures thereof.

9. The delivery apparatus of claim 1, wherein the functional material further comprises a material selected from the group consisting of alkanes, fluoroalkanes, alkyl silanes, fluoroalkyl silanes alkoxy-silanes, siloxanes, glycols or polyglycols, mineral oil, synthetic oil, natural oil, and mixtures thereof.

10. The delivery apparatus of claim 1, wherein the cleaning material comprises a material selected from the group consisting of polyurethane, polyamide, melamine resin, polyester, polysiloxanes, polyethylene, polyacrylates, natural rubber and synthetic rubber.

11. The delivery apparatus of claim 1, wherein the cleaning material comprises a brush.

12. The delivery apparatus of claim 1, wherein the cleaning material is selected from the group consisting of a foam and a fabric.

13. The delivery apparatus of claim 1, wherein the outer layer comprises a thickness of from about 0.1 μm to about 50 mm.

14. The delivery apparatus of claim 1, wherein the elastomeric matrix comprises pores having a size of from about 0.01 micron to about 50 microns.

15. The delivery apparatus of claim 1, further comprising an inner layer disposed between the support member and the outer layer.

16. An image forming apparatus comprising:

a) an imaging member having a charge retentive-surface for developing an electrostatic latent image thereon, wherein the imaging member comprises:

a substrate, and a photoconductive member disposed on the substrate;

b) a charging unit for applying an electrostatic charge on the imaging member to a predetermined electric potential; and c) a delivery member disposed in contact with a surface of the charging unit, wherein the delivery member comprises:

ii) a cylindrical support member, and iii) an outer layer disposed on the support member comprising an outer surface, the outer surface comprising a first surface section and a second surface section, the first surface section comprising an elastomeric matrix having a functional material dispersed therein and the second surface section comprising a cleaning material, wherein the delivery member provides a functional material to the surface of the charging unit at a rate of about 0.1 ng/cm$^2$ to about 1 μg/cm$^2$.

17. The image forming apparatus according claim 16, wherein the elastomeric matrix comprises a cross-linked polydimethylsiloxane (PDMS) and the functional material comprises a paraffin oil.

18. An image forming apparatus comprising:

a) an imaging member having a charge retentive-surface for developing an electrostatic latent image thereon, wherein the imaging member comprises:

a substrate, and a photoconductive member disposed on the substrate;

b) a charging unit for applying an electrostatic charge on the imaging member to a predetermined electric potential; and c) a delivery member disposed in contact with a surface of the imaging member, wherein the delivery member comprises:

ii) a cylindrical support member, and iii) an outer layer disposed on the support member comprising an outer surface, the outer surface comprising a first surface section and a second surface section, the first surface section comprising an elastomeric matrix having a functional material dispersed therein and the second surface section comprising a cleaning material, wherein the delivery member provides a functional material to the surface of the imaging member at a rate of about 0.1 ng/cm$^2$ to about 1 μg/cm$^2$.

* * * * *